US006498593B1

(12) United States Patent
Fujimoto et al.

(10) Patent No.: US 6,498,593 B1
(45) Date of Patent: Dec. 24, 2002

(54) PLASMA DISPLAY PANEL AND DRIVING METHOD THEREOF

(75) Inventors: Sunao Fujimoto, Kawasaki (JP); Hiroyuki Nakahara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/434,114

(22) Filed: Nov. 5, 1999

(30) Foreign Application Priority Data

Apr. 27, 1999 (JP) ..... 11-120087

(51) Int. Cl.[7] ..... G09G 3/30
(52) U.S. Cl. ..... 345/60; 345/77
(58) Field of Search ..... 313/493, 292, 313/582–587; 345/60, 62, 63, 67; 315/169

(56) References Cited

U.S. PATENT DOCUMENTS 5,793,158 A 8/1998 Wedding, Sr. ..... 313/493
6,060,827 A * 5/2000 Kichimi et al. ..... 313/582
6,169,527 B1 * 1/2001 Kanazawa et al. ..... 345/60
6,208,082 B1 * 3/2001 Kim et al. ..... 315/169
6,236,159 B1 * 5/2001 Inoue et al. ..... 313/582
6,278,238 B1 * 8/2001 Hong ..... 313/582

FOREIGN PATENT DOCUMENTS

JP 10-319868 4/1998

* cited by examiner

*Primary Examiner*—Vijay Shankar
*Assistant Examiner*—Nitin Patel
(74) *Attorney, Agent, or Firm*—Staas & Halsey LLP

(57) ABSTRACT

A plasma display panel includes a plurality of main electrodes laid out on one of a pair of substrates to have a stripe-shaped pattern, a plurality of sets of selection electrodes each set of which include a first electrode and a second electrode, laid out on the other of the pair of substrates to have a stripe-like pattern, and a plurality of ribs each of which is disposed extending from a cross point between an odd-numbered display line and the second selection electrode to a cross point between an even-numbered display line and the first selection electrode.

21 Claims, 12 Drawing Sheets

Odd-Numbered Line
Display Line
1
2
3
4
5
6
7
8
9
10
11
1021
1022
1023
1024

Even-Numbered Line

Screen
A
X1
Y1
Xn
Yn
Xn+1
t

PLASMA DISPLAY PANEL AND DRIVING METHOD THEREOF

CROSS-REFERENCES TO RELATED APPLICATIONS

This application is related to Japanese patent application No. HEI 11(1999)-120087 filed on Apr. 27, 1999 whose priority is claimed under 35 USC §119, the disclosure of which is incorporated herein by reference in its entirety.

BACKGROUND OF THE INVENTION

1. Field of the Invention

This invention relates to a plasma display panel ("PDP") and a driving method of the same. More particularly, the invention relates to a plasma display panel having multiple built-in discharge cells as formed at locations partitioned by barrier walls or ribs in a discharge space within a panel, and also to a driving method thereof.

2. Description of the Related Art

Currently available PDPs are thin flat-panel display devices with enhanced on-screen image visibility and high-speed displayability while offering large-screen attainability. One example of such devices is an active-matrix driven areal-dischargeable PDP unit, which is typically arranged so that display electrodes forming a pair upon application of a drive voltage are laid out on the same substrate. The active-matrix PDP of this type is preferably adaptable for use in displaying full-color images by means of fluorescent materials.

One typical known AC-driven color PDP of the areal discharge type is designed in a way which follows. Multiple pairs of main electrodes for use in producing an areal discharge are horizontally disposed in substantially parallel to one another on one of spatially laminated substrates making up a panel at a pre-specified interval or pitch of reverse slit (non-discharge region) while providing on the remaining substrate a plurality of address (signal) electrodes used for address discharge production and multiple stripe-shaped ribs for physically partitioning a discharge space, adjacent ones of which sandwiches a corresponding one of the address electrodes therebetween, in substantially parallel in the vertical direction (a direction transverse to the main electrodes), wherein fluorescent layers of the three primary colors—here, red (R), green (G), and blue (B)—are formed in a narrow elongate groove between adjacent ones of the ribs.

Note here that the areal discharge is sometimes called a "display discharge" in view of the fact that such discharge is a main discharge for image display and may also be called a "sustain discharge" because of the fact that it is a turn-on retaining discharge after addressing. Additionally, the main electrodes for areal discharge production are called "display electrodes" since these are display discharging electrodes, or alternatively are called "sustain electrodes" as they are the electrodes for use in producing the sustain discharge.

An on-screen image displaying operation of the PDP of this type is as follows. One sustain electrode of a sustain electrode pair is used as a scanning electrode to sequentially apply a voltage while during such voltage application applying a voltage to a desired address electrode causing an address discharge to take place between the address electrode and the one sustain electrode to thereby select a discharge cell to be turned on (this is generally referred to as "addressing"). Thereafter, by utilizing wall charge as has been formed during addressing, let a sustain discharge occur between paired sustain electrodes for an appropriate number of times that adequately complies with the intended luminance and color shade levels (thereby causing the discharge cell to turn on). To be brief, in case where one pixel consists of three separate RGB discharge cells, any desired color shade is reproducible by suitably determining what color of discharge cell is selected from RGB and how many times such cell is to be turned on; in this respect, the related art PDP is designed to produce the sustain discharge for a specified number of times as required to attain such reproducibility.

This gradation-of-shading displayability (color reproducibility) based on the control of the discharging number of such sustain discharge is typically attained by a method as will be discussed below. Subdivide a single frame (or a single field if one frame consists of two fields) into eight separate subfields, which are then subjected to weighting processing so that a relative ratio of these subfields' luminance intensities becomes 1:2:4:8:16:32:64:128 for setting up the number of sustain discharge occurrences of each subfield. This makes it possible to perform brightness setup of 256 different levels with respect to each of the RGB colors, which leads to on-screen displayability of $256^3$ kinds of possible colors.

Incidentally, currently available PDPs suffer from a physical limitation as to shrinking or "downsizing" of electrodes and ribs; due to this, the existing PDPs are encountered with a problem as to image quality reduction (low resolution) when employed for small-size screen displays when compared to traditional cathode-ray tube (CRT) display units, although the PDPs are adaptable for use with large-screen displays. To avoid this problem, several technical approaches to maximizing the required number of pixels (discharge cells) while minimizing requisite electrodes in number are proposed in recent years. One typical approach to achieving such maximal-pixel/minimal-electrode configuration is to employ a specific technique called an "alternate lighting of surfaces (ALiS)" scheme for use with AC-driven color PDPs of the areal discharge type.

This scheme is a technique which replaces the one as has been designed to use two separate sustain electrodes per display line to visually display an image and which realigns such sustain electrodes at the equal pitch to utilize those available spaces between all the sustain electrodes as display lines. With this scheme, as shown in FIGS. 10A, 10B and 10C, one frame is subdivided into two fields consisting of an odd-numbered field and an even-numbered field for causing in the odd-numbered field a sustain discharge to take place at an odd-numbered line between sustain electrodes $X_n$, $Y_n$ (where "n" is a given natural number) (see FIG. 10A) while producing in the even-numbered field a sustain discharge at an even-numbered line between sustain electrodes $Y_n$, $X_{n+1}$ (see FIG. 10B), wherein the odd-numbered and even-numbered lines are combined or synthesized together for constitution of a single on-screen image (see FIG. 10C). In the drawings, a dot-matrix display pattern of an alphabetical letter "A" is shown by way of example. A reference character A is used in this drawing to designate the address electrodes. Accordingly, this scheme permits the above-noted reverse slit portion to be used as part of an effective displayable region, which doubly increases the display lines in number without having to increasing the requisite number of electrodes involved.

This ALiS scheme requires the use of a panel structure shown in FIG. 11. More specifically, parallel sustain electrodes $X_n$, $Y_n$ are disposed in the horizontal direction on a display plane while parallel address electrodes A are laid out at right angles thereto in the vertical direction on the display plane, wherein ribs 31 are arranged between the address electrodes A in a way parallel to the address electrodes A. The exact number of such sustain electrodes is determined so that it is equal to the number of those discharge cells aligned in the vertical direction (vertical cell number) plus one—that is, the number of the sustain electrodes disposed is the display line number (2i) plus 1 (where "i" is the maximum electrode pair number whereas the number of the address electrodes is the same as the number of those discharge cells in the horizontal direction (horizontal cell number).

The display lines include a first display line $L_1$ as defined between the sustain electrodes $X_1$ and $Y_1$, a second display line $L_2$ between sustain electrodes $Y_1$ and $X_2$, a third display line $L_3$ between sustain electrodes $X_2$ and $Y_2$, a (2n−1)th display line $L_{2n-1}$ between sustain electrodes $X_n$ and $Y_n$, and an n-th display line $L_{2n}$ between sustain electrodes $Y_n$ and $X_{n+1}$.

As shown in a partially enlarged diagram of FIG. 12, each of the sustain electrodes X, Y consists of a transparent electrode 32 comprised of a transparent conductive film made typically of indium-tin-oxide (ITO) and a bus electrode 33 formed of a metallic film made of Cr—Cu—Cr or other similar suitable materials. In view of the fact that a sustain discharge is generated between the sustain electrodes X, Y between ribs 31, a discharge region between the sustain electrodes X, Y sandwiched between such ribs 31 becomes a discharge cell C.

With this scheme, when displaying an on-screen image, first use the sustain electrodes Y as scan electrodes to sequentially apply a voltage potential to the sustain electrodes $Y_1, Y_2, Y_3, \ldots, Y_n$; during such voltage application, addressing is done in a way that applies a voltage to any desired address electrode A for production of an address discharge. Thereafter, utilize electrical charge formed during such addressing to produce a sustain discharge between sustain electrodes $X_n$, $Y_n$ (during an odd-numbered field) or alternatively between sustain electrodes $Y_n$, $X_{n+1}$ (in an even-numbered field) for displaying any intended image on the screen.

In other words the ALiS scheme is inherently designed in such a way that scanning is done at the sustain electrodes Y in an odd-numbered field and, thereafter, let a sustain discharge take place between the sustain electrodes $X_n$, $Y_n$ (odd-numbered lines); after having again performed or re-performed scanning at the same sustain electrodes Y in an even-numbered field, produce a sustain discharge between the sustain electrodes $Y_n$, $X_{n+1}$ (even-numbered lines).

With regard to displaying gradations of shading, the luminance-weighted sustain discharging. number setup scheme discussed previously is also employed therefor, which is the same as that used in the PDP of the type which makes use of two separate sustain electrodes relative to a single display line in the way stated supra.

The above-noted ALiS scheme is more excellent than that used for PDPs of the type using two sustain electrodes per display line in that the former is capable of displaying an increased number of display lines while using a less number of electrodes. Unfortunately, this advantage does not come as to a need to separately display odd-numbered display lines and even-numbered display lines in a way independent of each other during image displaying. From such a viewpoint, there has long been desired a PDP with a specific structure capable of efficiently displaying high-quality images with enhanced precision.

SUMMARY OF THE INVENTION

This invention has been made in view of the technical background, and its primary object is to provide a plasma display panel along with its driving method capable of displaying both the content being displayed at odd-numbered display lines and the content being displayed at even-numbered display lines at a time, by disposing the ribs diagonally while providing two different kinds of address electrodes including those for the odd-numbered display lines and the other for even-numbered display lines.

To attain the foregoing object, this invention provides a specific plasma display panel, which comprises a plurality of main electrodes laid out on an inside surface of one of a pair of substrates to have a stripe-shaped pattern with a distance defined between adjacent ones of the main electrodes, the distance corresponding to a display line for use as a discharge cell region; a plurality of sets of selection electrodes laid out on an inside surface of the other of the pair of substrates to have a stripe-like pattern in a direction transverse to the main electrodes, each set of the selection electrodes including a first electrode forming a first discharge cell at a cross point with a display line and a second electrode forming a second discharge cell at a cross point with the display line; and a plurality of ribs for partitioning a discharge space formed between the pair of substrates, each of rib being disposed extending from a cross point between an odd-numbered display line and the second selection electrode to a cross point between an even-numbered display line and the first selection electrode.

With the PDP structure of this invention, during discharge cell selection, it is possible by use of the first and second selection electrodes to simultaneously select both a discharge cell located on an odd-numbered display line and a discharge cell on an even-numbered display line at a time.

In addition, in discharge cell turn-on events, it is possible by using three main electrodes to simultaneously turn on both a discharge cell positioned on an odd-numbered display line and a discharge cell at an even-numbered display line at a time.

Use of the above inventive teachings permits occurrence of a surplus or "idle" time duration within the discharge cell turn-on time period, which in turn makes it possible to establish enhanced image displayability with an increased number of gradations of color shading, thereby enabling successful on-screen visualization of more crisp and vivid images high in precision and rich in shades of possible colors. In addition, lengthening turn-on time makes it possible to increase the luminance or brightness of displayed images, which in turn enables such images to increase in contrast on the screen.

DESCRIPTION OF THE PREFERRED EMBODIMENTS

Figure 1:
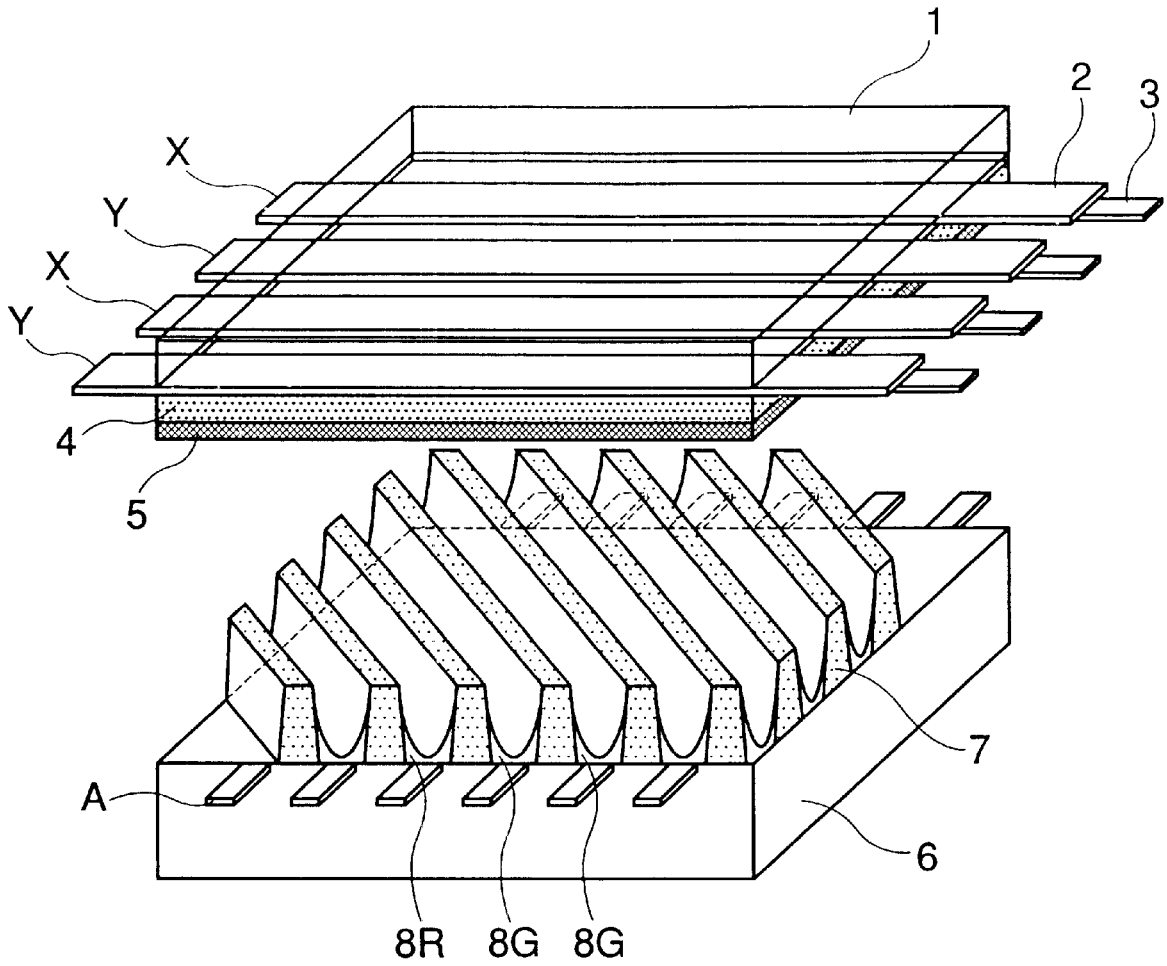
FIG. 1 is a diagram showing a perspective view of an internal structure of a PDP in accordance with one embodiment of the present invention.

The plasma display panel (PDP) incorporating the principles of the invention is adaptable for use as active-matrix PDPs of any type, including the DC type and AC type.

The PDP of this invention is arranged to employ a pair of spaced-apart substrates, which may be made of glass, quartz, silicon or other similar suitable materials with desired constituent components formed thereon, including but not limited to electrodes and insulative films plus dielectric layers as well as protective films or else.

In this invention, the language "stripe-shaped layout" as used herein may refer in principle to a specific layout pattern of regularly spaced parallel narrow strips. These strips are preferably arranged so that these are spaced at a substantially equal interval; note however that they are not exclusively limited to such linear strips and may alternatively be replaced with curved strips as the need arises.

Preferably, the main electrodes may be formed of multiple areal-discharging sustain electrodes as laid out in parallel to one another at an equal interval or pitch in the horizontal direction. Such main electrodes of this type may be configurable by using known ones in the art to which the invention pertains. Typically, each main electrode may be comprised of a multilayer structure of a transparent conductive film and a metallic film. In this case the main electrode may be arranged so that it consists essentially of a bus electrode of band-like shape made of a metallic film and a band-like transparent electrode extending in parallel to the bus electrode and connected thereto. The main electrode may alternatively be configured from a band-like metallic film bus electrode and its associative transparent conductive film that is coupled to the bus electrode and projects at a discharge cell position from the bus electrode toward the central portion of such discharge cell.

It is desirable that the selection electrodes be formed of multiple equally spaced parallel address electrodes that are aligned in the vertical direction. Configuration and designing of these selection electrodes per se will readily occur to those skilled in the art. One example is that each selection electrode is formed of a metallic film. The selection electrodes are substantially two times greater in number than those discharge cells as laid out within a single display line.

The display lines are such that each is formed between adjacent ones of the neighboring main electrodes while letting a discharge cell be formed at a cross point or "intersection" between a couple of main electrodes forming one display line and a single selection electrode.

The ribs may be made of currently available materials and fabricated by known manufacturing method in the art.

The ribs are preferably arranged so that a rib is linearly disposed overlying a line segment that connects between two specified intersections, one of which lies between an odd-numbered display line and the second selection electrode and the other of which is between an even-numbered display line and the first selection electrode.

In accordance with another aspect of this invention, a plasma display panel driving method is provided, which includes the steps of selecting, during discharge cell selection, both a discharge cell located at an odd-numbered display line and a discharge cell at an even-numbered display line at a time; and energizing in a discharge cell turn-on event both the discharge cell at the odd-numbered display line and the discharge cell at the even-numbered display line at a time thereby causing them to turn on simultaneously.

In this drive method, it will be desirable that an odd-numbered display line is designed to visually display a content corresponding to one of two fields as subdivided from a frame, which is an odd-numbered-number field, while allowing an even-numbered display line to display a content corresponding to an even-numbered-number field of the frame.

Also preferably, during discharge cell selection, even-numbered main electrodes are used as scan electrodes for sequential application of a scan voltage.

Simultaneous selection of a discharge cell located at an odd-numbered display line and a discharge cell at an even-numbered display line is performed, when a certain main electrode is scanned, by simultaneous application of a select voltage to both a first selection electrode and a second selection electrode extending transverse to the main electrode thereby causing generation of a discharge.

Additionally, simultaneous turn-on activation of a discharge cell located at an odd-numbered display line and a discharge cell at an even-numbered display line is done by causing simultaneous production of a discharge from an even-numbered main electrode toward two odd-numbered main electrodes neighboring upon the main electrode and then by letting a discharge simultaneously take place in a reverse direction thereto.

The PDP drive method in accordance with the present invention may also be arranged so that the method comprises the steps of dividing a frame into a plurality of subfields each consisting essentially of an address period and a turn-on retaining discharge period; scanning alternate ones of main electrodes or every other main electrode during the address period of each subfield thereby causing simultaneous creation of an addressing discharge between a single main electrode as selected during scanning and two associative selection electrodes lying in an identical rib space to intersect the main electrode; and utilizing, in the turn-on retaining discharge period, electrical charge carriers occurred due to the addressing discharge to permit simultaneous production of a turn-on retaining discharge between one main electrode and its neighboring main electrode lying within an identical rib space.

Some preferred embodiments of this invention will now be described in detail with reference to the accompanying drawings below. Note that the embodiments which follow are presented for purposes of illustration of the inventive teachings only and hence should not be used as any basis for limitative interpretation of the invention.

Referring now to FIG. 1, there is illustrated a perspective view of an inside configuration of a plasma display panel (PDP) in accordance with one preferred embodiment of the instant invention. The illustrative PDP device may be a full-color active-matrix PDP with a three-electrode areal discharge structure of the AC type.

As shown in FIG. 1, the PDP has a pair of spatially laminated substrates, one of which is a front-side glass substrate 1 having on its internal surface an alternate array of regularly spaced parallel conductive strips acting as sustain electrodes ("main electrodes" or "display electrodes") X, Y. Linear interspace portions among such sustain electrodes X, Y define display lines that are linear discharge cell arrays in the horizontal direction on a display screen, wherein an interspace between one sustain electrode X and its neighboring sustain electrode Y becomes an odd-numbered display line whereas an interspace between the sustain electrode Y and its adjacent sustain electrode X next thereto is an even-numbered display line. Each of the sustain electrodes X, Y is formed of a lamination of a transparent conductive film 2 made of indium-tin-oxide (ITO) and a metallic film (bus electrode) 3 made of Cr—Cu—Cr, which lamination is coated with a dielectric layer 4 made of low-melting-point glass of approximately 30 micrometers ($\mu$m) in thickness. The dielectric layer 4 has on its exposed surface a protective film 5 made of magnesia (MgO) that measures several thousands of Angstrom.

The other of the substrates is a back-side glass substrate 6, which has on its internal surface an undercoat layer or underlayer (not shown) with equally spaced parallel address electrodes (signal transfer electrodes) A laid out thereon, which in turn are coated with a dielectric layer (not shown) of 10-$\mu$m thick, or more or less. Provided on such dielectric layer are ribs 7 of stripe shape made of a chosen low-melting-point glass material of 150 $\mu$m in height, which are arranged to diagonally extend relative to the address electrodes A. These ribs 7 are for partitioning a thin gap-say, discharge space-between the front glass substrate 1 and the back glass substrate 6 into multiple narrow grooves for use as unit regions for light emission, known as "sub-pixels," while at the same time defining the exact dimensions of such discharge space. Provided within such interib grooves are stripe-shaped fluorescent layers 8 for use in producing rays of light in three primary colors of red (R), green (G), and blue (B)—in this sense, the fluophor layers are designated by 8R, 8G, 8B-for displaying of full-color images in a manner such that a fluophor layer covers certain portions overlying the address electrodes A and also inner sidewalls of corresponding adjacent ribs 7. The three color layout pattern used herein is a stripe pattern, wherein those discharge cells lying in a groove are the same in color of emitted light as one another whereas neighboring grooves are different from each other in luminescent color. Optionally the ribs 7 may be subjected to color development during manufacturing processes so that the top portions thereof are colored into dark color for contrast enhancement purposes. Such coloring is typically done by adding pigment of specified color to glass paste materials.

The discharge space is filled with a discharge gas consisting substantially of a mixture of neon and xenon gases (at a pressure of about 500 Torr) thereby letting the fluophor layers 8R, 8G, 8B be locally excited by ultraviolet rays emitted from the sealed xenon gas during discharging to produce visible rays of light. One pixel consists of three separate sub-pixels that are aligned together beyond their associated ribs 7. A structure within each subpixel is a discharge cell (display element). As the layout pattern of the ribs 7 is designed into the stripe pattern discussed above, the resultant discharge space extends diagonally along the ribs 7.

Figure 2:
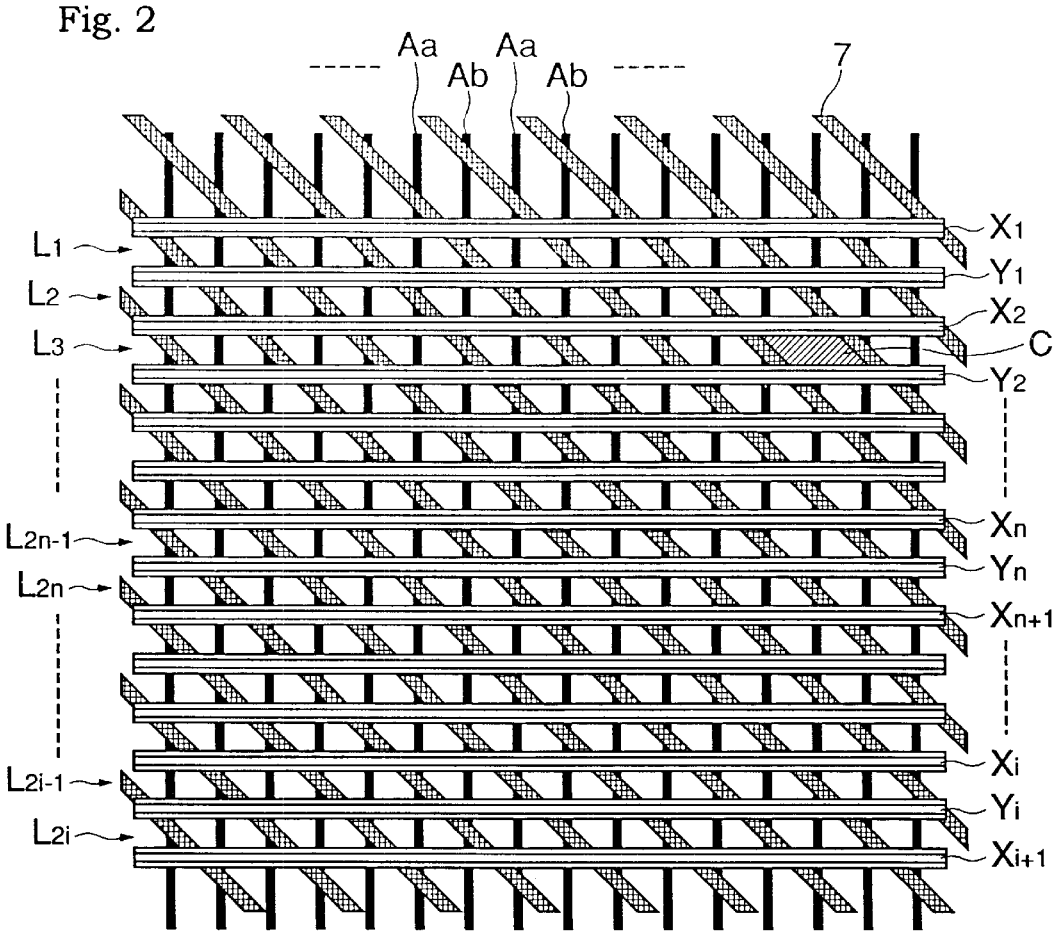
FIG. 2 is a diagram for explanation of a planar panel structure of the PDP of the illustrative embodiment.

Referring next to FIG. 2, there is depicted a planar view of the panel structure of the PDP of FIG. 1.

As better shown in FIG. 2, the PDP embodying the invention is arranged so that equally spaced parallel sustain electrodes $X_n$, $Y_n$ are laid out in the horizontal direction on the display screen to permit creation of an areal discharge between neighboring electrodes while vertically regularly spaced parallel address electrodes A of stripe shape are disposed at right angles thereto. The requisite number of the sustain electrodes is equal to the number of those discharge cells aligned in the vertical direction (vertical cell number) plus one (1); more specifically, the sustain electrode number is set at a selected number that is defined as a display line number (2i) plus 1, where "i" is the maximal electrode pair number. The address electrodes disposed are two times greater in number than those discharge cells aligned in the horizontal direction (horizontal cell number).

The display lines L include a first display line $L_1$ lying between the sustain electrodes $X_1$ and $Y_1$, a second line $L_2$ between the sustain electrodes $Y_1$, $X_2$, a third line $L_3$ between sustain electrodes $X_2$, $Y_2$, (2n−1)th display line $L_{2n-1}$ between sustain electrodes $X_n$, $Y_n$, and 2n-th display line $L_{2n}$ between sustain electrodes $Y_n$, $X_{n+1}$. Alternate display lines, $L_{2n-1}$, are odd-numbered display lines whereas the remaining alternate display lines, $L_{2n}$, are even-numbered display lines.

The address electrodes A consist of address electrodes Aa for use with odd-numbered display lines and address electrodes Ab for even-numbered display lines, wherein the odd-numbered display line address electrodes Aa are designed to receive a voltage potential during selection (addressing) of more than one discharge cell of the odd-numbered display lines $L_{2n-1}$ whereas the even-numbered display line address electrodes Ab are potentially activated upon selecting of one or more discharge cells of the even-numbered display lines $L_{2n}$.

The ribs 7 are provided for partitioning the discharge space formed between the substrates, wherein each rib is arranged as a linear strip diagonally extending from an intersection between an odd-numbered display line $L_{2n-1}$ and its associative even-numbered display line address electrodes Ab via an intersection between an even-numbered display line $L_{2n}$ and odd-numbered display line address electrodes Aa.

In other words the individual one of the ribs 7 is specifically arranged to linearly elongate diagonally to permit both an odd-numbered line Is discharge region as formed at an intersection between the odd-numbered display line $L_{2n-1}$ and the odd-numbered display line address electrode Aa to be spatially continuously associated with an even-numbered line discharge cell's discharge region at an intersection formed between the even-numbered display line $L_{2n}$ and even-numbered display line's address electrode Ab.

Figure 3:
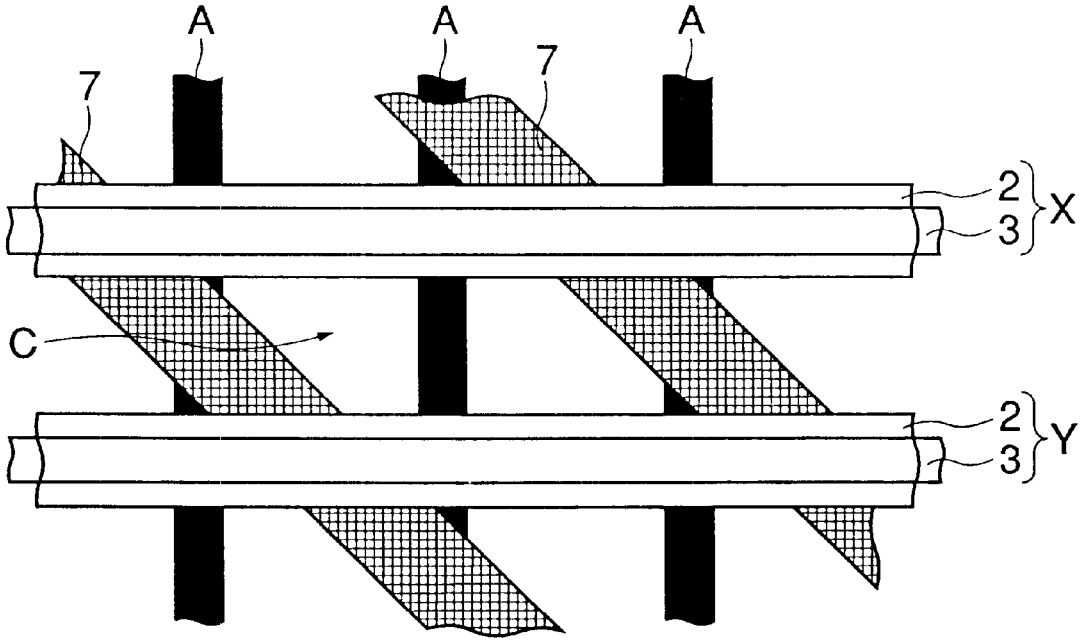
FIG. 3 is a diagram enlargedly depicting a portion of the PDP of the embodiment for showing a detailed configuration of a discharge cell used therein.

Turning now to FIG. 3, there is depicted an enlarged plan view of one of the discharge cells. As previously stated, the sustain electrodes X, Y are each structured from the transparent conductive film (referred to as "transparent electrode" hereinafter) 2 and metallic film (referred to hereafter as "bus electrode") 3. Since a sustain discharge typically occurs between such sustain electrodes X, Y lying between a rib 7 and another rib 7 next thereto, a certain discharge region of parallelogram that is defined by such two adjacent ribs 7 and the neighboring sustain electrodes X, Y becomes a discharge cell C.

Figure 4:
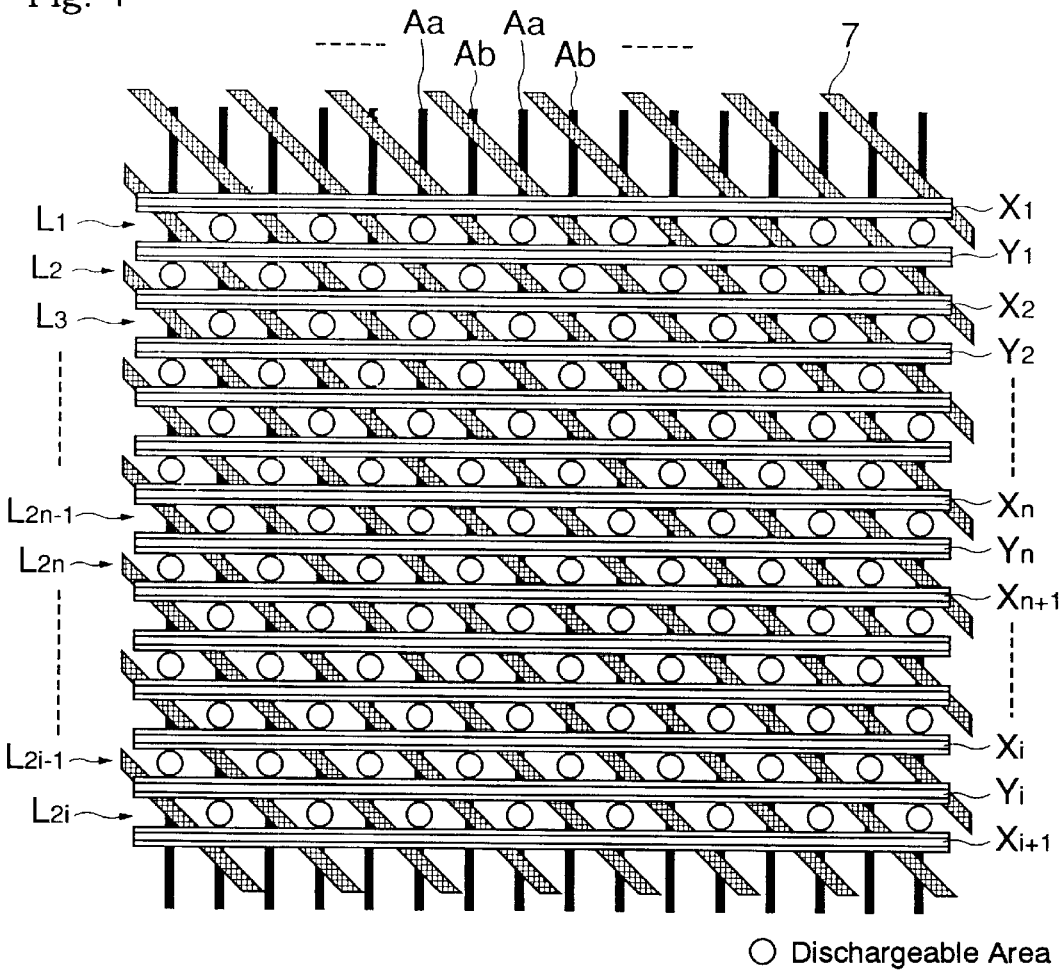
FIG. 4 is a diagram illustrating a planar layout pattern of discharge cells included in the PDP of the embodiment.

See FIG. 4. This diagram depicts a layout pattern of the discharge cells with increased legibility. In FIG. 4, iconic marks "○" are used to indicate several dischargeable areas, which serve as the discharge cells C. In the illustrative PDP the discharge cells are diagonally disposed along the ribs 7 as can be seen from this diagram.

The number of electrodes required is as follows. Suppose that a dot matrix of the PDP consists of 2,556 discharge cells in the horizontal direction and 480 cells in the vertical direction. This requires use of 2,556 odd-numbered display line address electrodes Aa along with 2,556 even-numbered display line address electrodes Ab, which results in the overall requisite address electrodes becoming 5,112 in total number thereof. The number of the sustain electrodes needed is 481, which is resulted from calculation of 480+1. The sustain electrodes are designed to allow alternate ones thereof to be used as scan electrodes, which are 240 in number.

Figure 5:
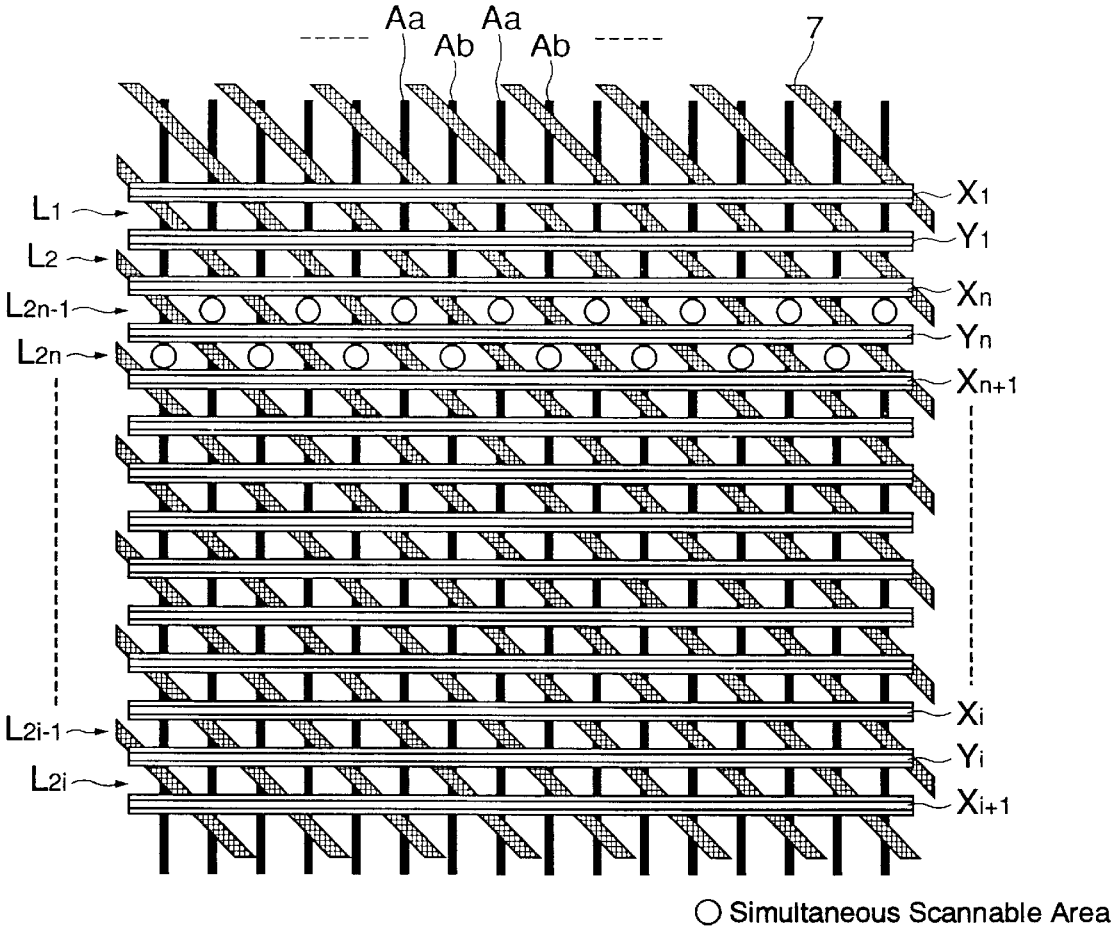
FIG. 5 is a diagram depicting the discharge cell layout for explanation of a discharge cell addressing scheme along with the state of sustain discharge in the PDP of the embodiment.

See FIG. 5, which is a pictorial representation for explanation of a discharge cell addressing scheme and also the state of sustain discharging. An on-screen image visualization procedure begins with a step of performing what is called the "address preparation" processing. Then, the procedure goes to a step of letting any residual electrical charge carriers be depleted or zeroed. The procedure goes next to a step of performing addressing to permit creation of a discharge for use in addressing.

During this addressing, use the sustain electrodes Y as the scan electrodes to sequentially apply a voltage to the sustain electrodes $Y_1$, $Y_2$, $Y_3$, . . . , $Y_n$, . . . , $Y_i$ in this order of sequence. During such voltage application, perform simultaneous selection of certain discharge cells at one odd-numbered display line $L_{2n-1}$ and its neighboring even-numbered display line $L_{2n}$ with a specific sustain electrode that is presently selected as the scan electrode lying midway between the display lines.

A detailed explanation of such simultaneous cell selection scheme is as follows. When selecting a discharge cell on the odd-numbered display line $L_{2n-1}$, apply a voltage to the odd-numbered display line address electrode Aa while a scan voltage is being applied to the sustain electrode $Y_n$, thereby causing creation of an addressing discharge between the odd-numbered display line address electrode Aa and the sustain electrode $Y_n$. Similarly, upon selecting of a discharge cell on the even-numbered display line $L_{2n}$, a voltage is applied to the even-numbered display line address electrode Ab while the scan voltage is being applied to the sustain electrode $Y_n$, thus letting an addressing discharge take place between the even-numbered display line's address electrode Ab and the sustain electrode $Y_n$.

The marks "○" as used in FIG. 5 specify selectable discharge cells at the odd-numbered display line $L_{2n-1}$ and those at the even-numbered display line $L_{2n}$ during application of the scan voltage to the sustain electrode $Y_n$.

Assuming that a single "page" of image for display (one frame) is subdivided into fields consisting of the odd-numbered and even-numbered ones, the selection of the odd-numbered display line $L_{2n-1}$'s discharge cells corresponds to the content of a display of the odd-numbered field whereas the selection of the even-numbered display line $L_{2n}$'s discharge cells corresponds to the display content of the even-numbered field.

In the way discussed above, upon application of the scan voltage to the sustain electrode $Y_n$, addressing is done to both the odd-numbered display line $L_{2n-1}$ on the upper side of the sustain electrode $Y_n$ and the even-numbered display line $L_{2n}$ on the lower side thereof at a time. In short, scanning of a single sustain electrode permits simultaneous addressing of two separate display lines.

Thereafter, electrical charge carriers formed during addressing to reside on the walls of sustain electrode $Y_n$ are used to simultaneously produce both a sustain discharge at the odd-numbered display line $L_{2n-1}$ between the sustain electrodes $X_n$, $Y_n$ and a sustain discharge at the even-numbered display line $L_{2n}$ between sustain electrodes $Y_n$, $X_{n+1}$, thereby to perform visualization of a display image. More specifically, let both of two display lines as designated by the marks "○" in FIG. 5 produce a sustain discharge at a time.

To simultaneously produce such sustain discharge between the sustain electrodes $X_n$, $Y_n$ and between sustain electrodes $Y_n$, $X_{n+1}$, let an application voltage for production of a sustain discharge (referred to hereafter as sustain voltage) between sustain electrodes $Y_n$, $X_n$ be identical to a sustain voltage between sustain electrodes $Y_n$, $X_{n+1}$. One example is that if the sustain voltage is at 80 volts (V) then apply a voltage of +80V to the sustain electrode $Y_n$ while maintaining the sustain electrode $X_n$ and sustain electrode $X_{n+1}$ at zero potential (ground connection) to ensure that a potential difference between these electrodes is equal to the sustain voltage. Thereby, first let both a discharge from the sustain electrode $Y_n$ toward sustain electrode $X_n$ and a discharge from sustain electrode $Y_n$ to sustain electrode $X_{n+1}$ take place simultaneously.

Next, apply a sustain voltage to permit production of a discharge in the reverse direction thereto. More specifically, let a potential difference between the sustain electrode $X_n$ and sustain electrode $Y_n$ be the same as a potential difference between the sustain electrode $X_{n+1}$ and sustain electrode $Y_n$. Thereby, let both a discharge from the sustain electrode $X_n$ toward sustain electrode $Y_n$ and a discharge from sustain electrode $X_{n+1}$ to sustain electrode $Y_n$ take place simultaneously. Obviously at this time, a discharge from sustain electrode $X_n$ to sustain electrode $Y_1$ and a discharge from sustain electrode $X_{n+1}$ to sustain electrode $Y_{n+1}$ will also occur.

Accordingly, the sustain discharge results in alternate production of a discharge from the sustain electrode Y toward sustain electrode X and a discharge from sustain electrode X to sustain electrode Y at all the display lines L on the screen.

In this way three neighboring sustain electrodes are contributed to formation of two display lines consisting of an odd-numbered display line and even-numbered display line, both of which will be simultaneously subjected to addressing for further display.

For shading display by controlling the discharge number of such sustain discharge, a single frame is divided into a plurality of subfields, which are then weighted in luminance or brightness thereof to thereby set up an appropriate number of sustain discharge of each subfield similarity to the ALiS scheme stated supra.

Figure 6:
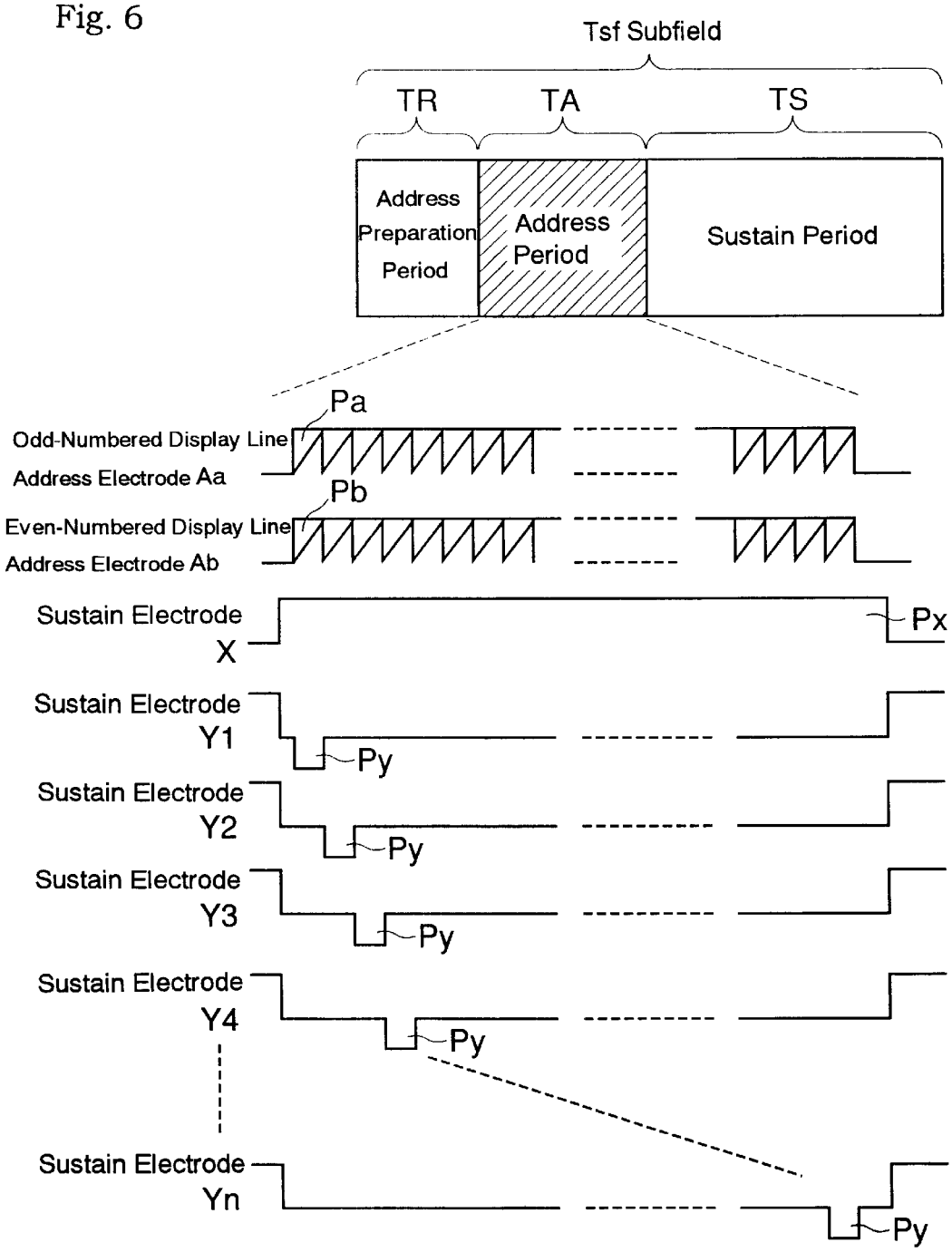
FIG. 6 is a timing diagram showing an exemplary pulse sequence of the waveforms of some major panel drive signals during addressing in the PDP of the embodiment.

Turning to FIG. 6, there is exemplarily illustrated the waveforms of some major drive signals used in the panel during addressing.

When displaying an image, one frame is divided into a preselected number—e.g., nine (9)—subfields, which are then subjected to weighting processing so that the relative ratio of the luminance of these subfields is 1:2:4:8:16:32:64:128:256 to thereby set up the requisite number of sustain discharge of each subfield. With this setting, it becomes possible to establish 512 possible brightness levels or shades relative to each of red (R), green (G) and blue (B) colors; thus, a total of cube of 512 ($512^3$) different colors may be displayable.

Then, let a period Tsf of each subfield be split into an address preparation period TR for preparation of addressing and an address period TA for execution of addressing plus a sustain period TS for performing sustain discharging. With such weighting and period setup, apply an appropriate voltage to each electrode for driving the PDP.

In the address preparation period TR of each subfield, the addressing preparation includes letting electrical charge of all discharge cells be set at "0." This may be done by a known method as has been employed in the ALiS scheme.

Next, in the address period TA, row selection is carried out by using the sustain electrodes Y as the scan electrodes to sequentially apply scan pulses Py to the sustain electrodes $Y_1, Y_2, Y_3, \ldots, Y_n, \ldots, Y_i$ in this order.

During such sequential scan pulse application, apply an address pulse Pa to the address electrode Aa associated with an odd-numbered display line corresponding to a discharge cell to be turned on in a way synchronous with the scan pulse Py to thereby produce an address discharge while at the same time applying an address pulse Pb to the address electrode Ab associated with an even-numbered display line corresponding to a discharge cell to be lit for production of an address discharge. During such addressing, apply a constant biasing pulse Px to a common sustain electrode X to prevent creation of a discharge between the address electrode A and sustain electrode X.

Next, in the sustain period TS, let a sustain discharge take place simultaneously both at the odd-numbered display line $L_{2n-1}$ and even-numbered display line $L_{2n}$ for a selected number of times as determinable in a way corresponding to the brightness level number and the number of gradation of shading of possible colors, thereby forming elements of a dot-matrix display on the screen.

It should be noted that the PDP driving method typically includes what is called the "write-address" drive method and the so-called "erase-address" drive method. The former is a driving method which includes the steps of setting discharge cells' electrical charge at "0" all at a time in an address preparation period and thereafter, during addressing, forming charge with respect only to target discharge cell or cells to be turned on. The latter is a drive method that includes the steps of uniformly forming electrical charge relative to all the discharge cells in the address preparation period and then, during addressing, deleting or "erasing" electrical charge at certain discharge cell(s) as required to remain inoperative or turned off.

Although the drive method embodying this invention has been explained under the assumption that it is applied to the case of driving by write-address scheme, the invention should not exclusively be limited thereto and may also be adaptable for use with the erase-address drive method.

Figures 7A, 7B, 7C:
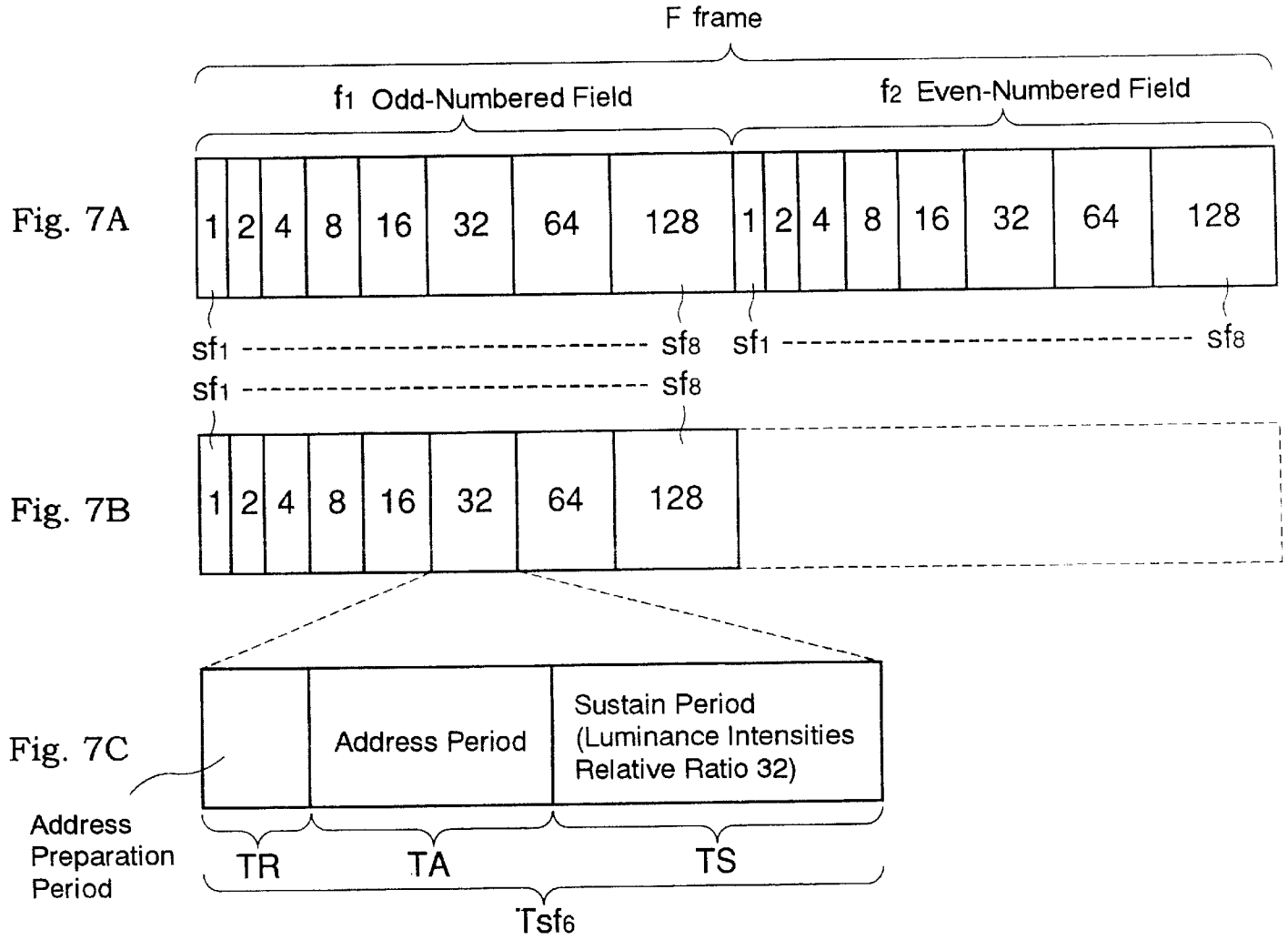
FIGS. 7A, 7B and 7C are a diagram showing a structure of one frame of the PDP embodying the invention along with a prior known "ALiS" scheme for comparison.

See FIGS. 7A, 7B and 7C, which depict a frame structure of the embodiment when compared to that in the ALiS scheme discussed previously, wherein FIG. 7A illustrates a frame structure used in the ALiS scheme, FIG. 7B shows a frame structure of this embodiment, and FIG. 7C depicts the content of the sixth subfield period $Tsf_6$ as one example of the subfields shown in FIG. 7B.

As shown in FIG. 7A, the previously stated ALiS scheme is traditionally designed so that one frame F is divided into an odd-numbered field $f_1$ and even-numbered field $f_2$, each of which is further divided into, for example, eight separate subfields $sf_1$–$sf_8$ which are then subjected to weighting processing thus letting the relative ratio of these sub fields brightness levels be set at 1:2:4:8:16:32:64:128 to thereby establish the number of sustain discharge events in each subfield. Accordingly, it has been required that the same drive be repeated for the odd-numbered field and also for even-numbered field.

By contrast, with the scheme of the illustrative embodiment of the invention, addressing with respect to those discharge cells of an odd-numbered field (odd-numbered display line) and addressing relative to discharge cells of an even-numbered field (even-numbered display line) are done simultaneously; further, the sustain discharging is performed in a way such that both a sustain discharge of the odd-numbered display line and sustain discharge of the even-numbered display line take place at a time.

Consequently, in cases where driving is done by a shade display method that is the same as the ALiS scheme stated previously, the scheme of the illustrative embodiment offers an ability to visually display an image corresponding to one frame within a shortened time period that is about ½ of the frame as well demonstrated in FIG. 7B. With such an arrangement, at a drive frequency equal to that in the above-noted ALiS scheme, it is possible to establish a further increased number of subfields, which may in turn enable the subfields to increase in number within a single frame thereby making it possible to fine the brightness setup levels during shade displaying.

By way of example, it is also possible to let a single frame consist of nine subfields where appropriate; thus, constituting one frame from nine subfields which are subjected to weighting causing the relative luminance level ratio thereof to become 1:2:4:8:16:32:64:128:256 while setting up an appropriate number of sustain discharge events in each subfield makes it possible to establish 512 different brightness levels per each of RGB colors, which leads to achievement of enhanced displayability of $512^3$ possible colors.

Figure 8:
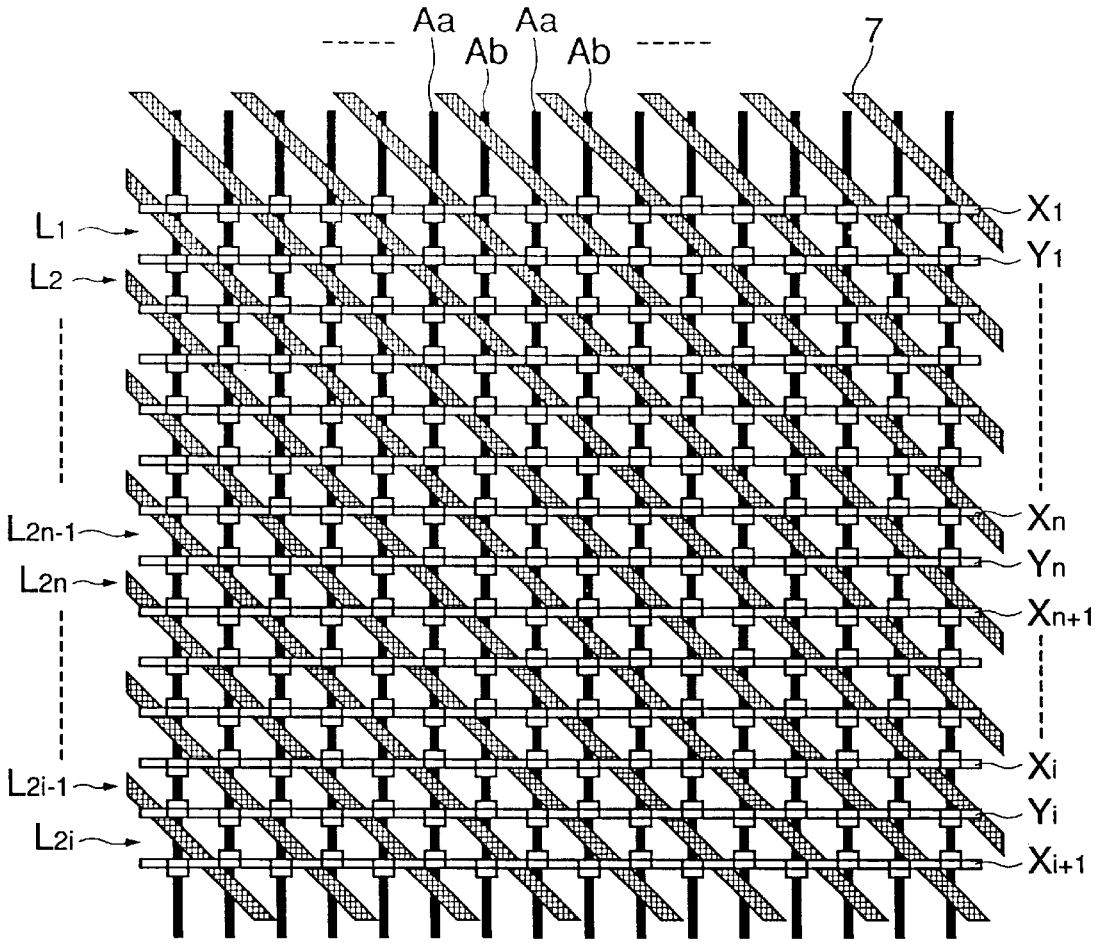
FIG. 8 is a diagram showing a plan view of a panel structure in accordance with another embodiment of the invention.

Referring to FIG. 8, there is shown a plan view of a panel structure of a PDP in accordance with another embodiment of the invention.

This embodiment shown herein is similar in structure of the address electrodes Aa, Ab and ribs 7 to the PDP shown in FIG. 2, with the sustain electrodes X, Y being different in structure therefrom.

Figure 9:
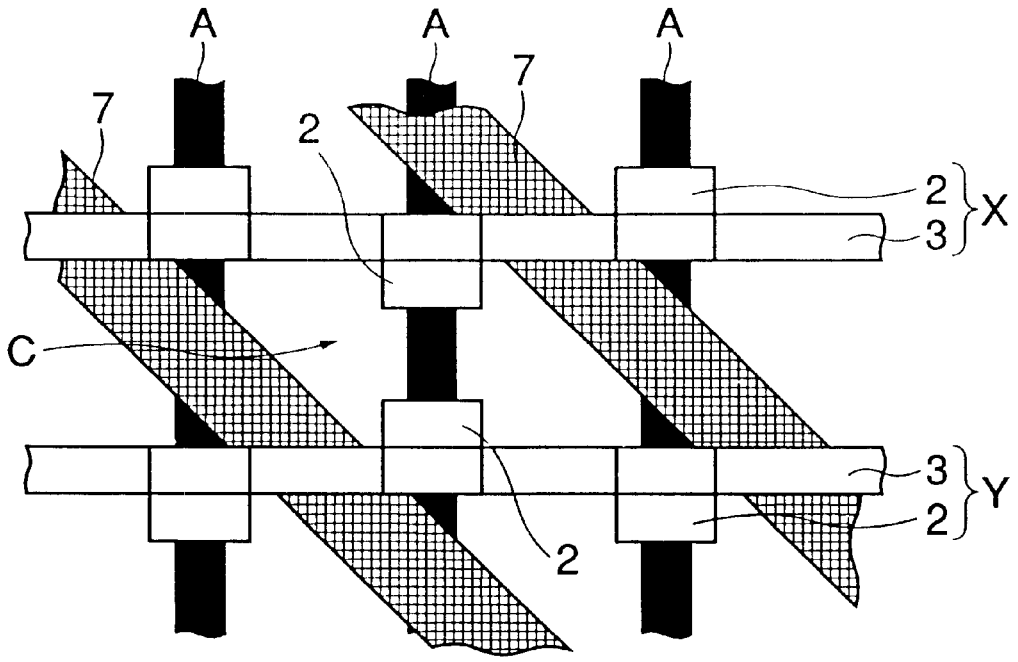
FIG. 9 is a diagram showing a partially enlarged view of a discharge cell in the PDP shown in FIG. 8.
Figures 10A, 10B, 10C:
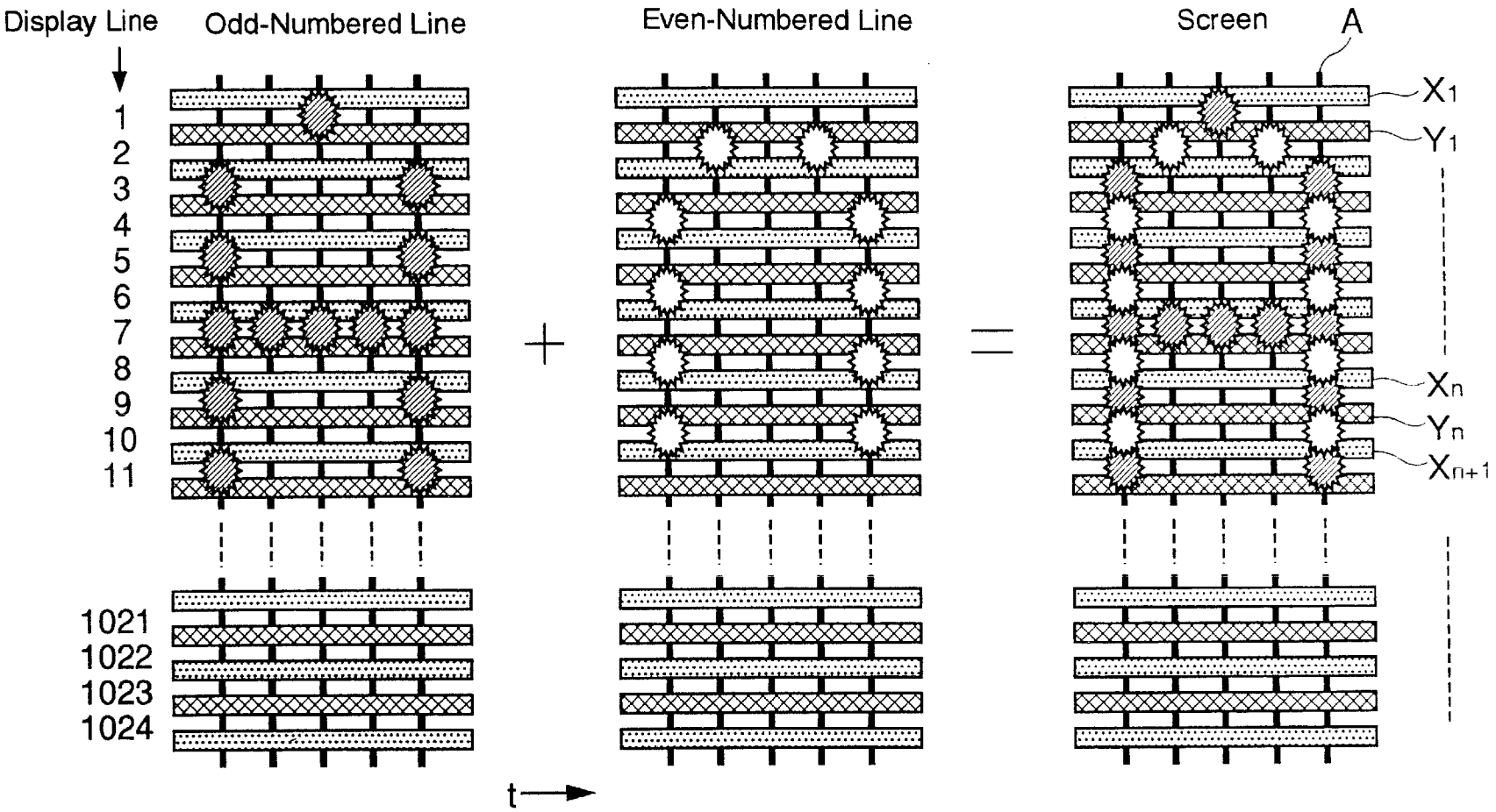
FIGS. 10A, 10B and 10C are a diagram showing several on-screen display states in the ALiS scheme.
Figure 11:
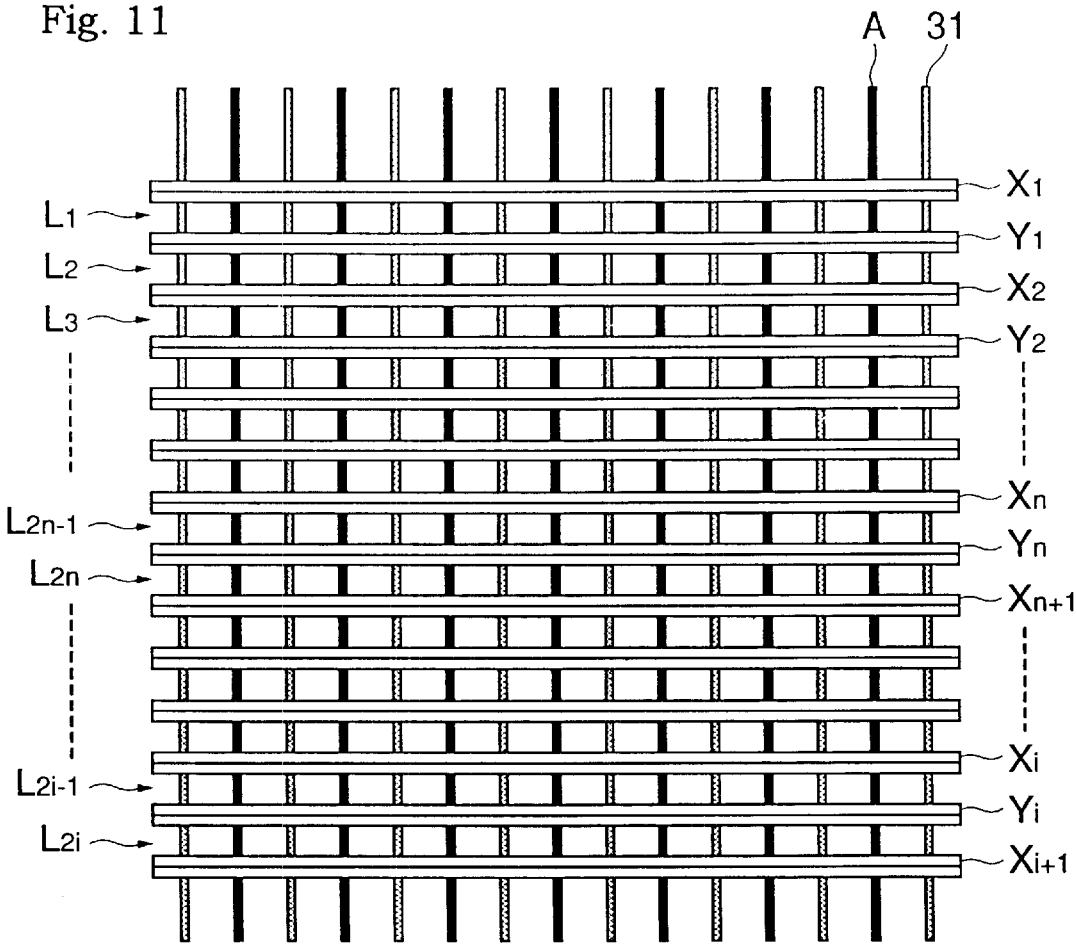
FIG. 11 is a diagram showing a plan view of an ALiS scheme-based panel structure.
Figure 12:
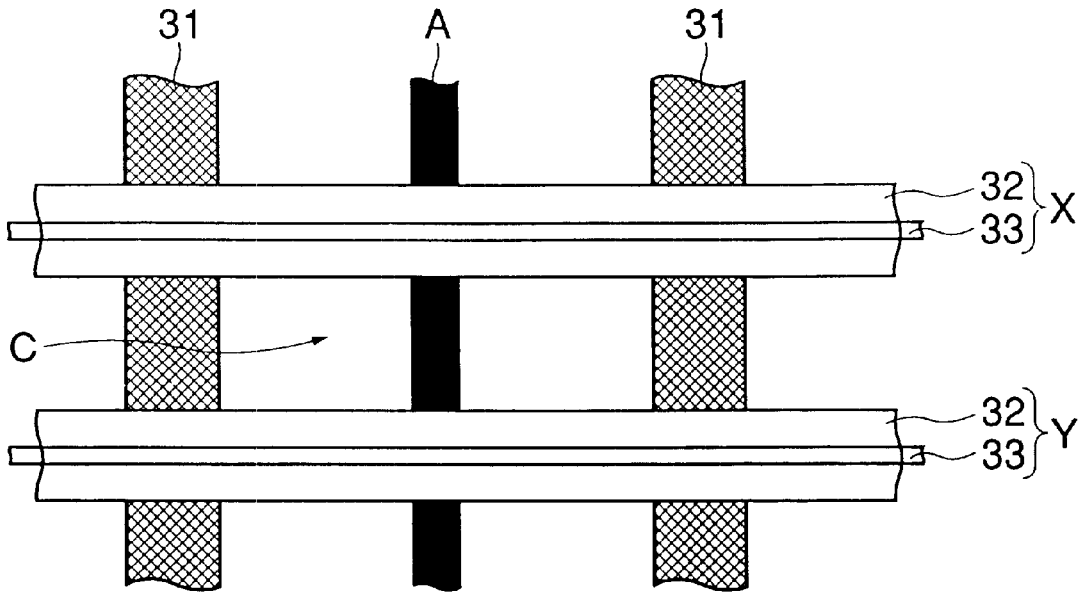
FIG. 12 is a diagram showing an enlarged view of one discharge cell used in the ALiS-scheme PDP shown in FIG. 11.

See FIG. 9 which depicts a partially enlarged view of one discharge cell used in the PDP of FIG. 8 for explanation of a detailed structure thereof. Although in this embodiment a parallelogram-shaped discharge region defined between two neighboring ribs 7 and adjacent ones of the sustain electrodes X, Y is reserved as a discharge cell C in a manner similar to that in the PDP of FIG. 3, this example is different from the FIG. 3 PDP in that each of the sustain electrodes X, Y consists of a band-shaped bus electrode 3 disposed in the horizontal direction and a transparent electrode 2 that is projected at the position of discharge cell C from such bus electrode 3 toward the central portion of the discharge cell. The transparent electrode 2 and bus electrode 3 are manufacturable by presently available techniques that would readily occur to those skilled in the art. Optionally the transparent electrode may alternatively be formed into T-like shape.

Where the sustain electrodes are designed to have such structure, a sustain discharge is well controlled to take place only at a location between the projected transparent electrodes 2 sitting vis-a-vis in the cell C thereby enabling localization of the discharge region, which in turn makes it possible to eliminate creation of any unwanted discharge coupling between neighboring discharge cells lying a narrow gap space between adjacent ones of the ribs 7 thus enabling on-screen visualization of clear and crisp images.

In this way, disposing the diagonally extending ribs while providing two kinds of address electrodes including odd-numbered-and even-numbered display lines for producing both an addressing discharge between a single sustain electrode and an odd-numbered display line address electrode and also producing such discharge between the sustain electrode and an even-numbered display line address electrode at a time and further for simultaneously producing a sustain discharge between a single sustain electrode and two neighboring sustain electrodes next to the sustain electrode makes it possible to display an odd-numbered display line and even-numbered display line simultaneously.

Thus, it becomes possible to lengthen the sustain discharge time period. This makes it possible to increase the number of the subfields, thereby achieving enhanced displayability of high-quality on-screen images with fine graduation of shading. In addition, the lengthening of the sustain discharge time leads to an ability to increase the luminance or brightness of a displayed image, which in turn makes it possible to display a high-contrast image on the screen.

According to this invention, it is possible to simultaneously display both odd-numbered display lines and even-numbered display lines at a time. Accordingly, it becomes possible to provide surplus to a discharge cell turn-on time, which in turn makes it possible to allow the number of subfields to likewise increase thereby enabling successful visualization of high-quality images with fine gradations of color shading. In addition, lengthening the turn-on time period makes it possible to increase the luminance intensity or brightness of an image displayed, thus enabling high-contrast images to be displayed on the screen.

What is claimed is:

1. A plasma display panel comprising:

a plurality of main electrodes laid out on an inside surface of one of a pair of substrates to have a stripe-shaped pattern with a distance defined between adjacent ones of the main electrodes, the distance corresponding to a display line for use as a discharge cell region;

a plurality of sets of selection electrodes laid out on an inside surface of the other of the pair of substrates to have a stripe-like pattern in a direction transverse to the main electrodes, each set of the selection electrodes including a first electrode forming a first discharge cell at a cross point with a display line and a second electrode forming a second discharge cell at a cross point with the display line; and a plurality of ribs for partitioning a discharge space formed between the pair of substrates, each of the ribs being disposed extending from a cross point between an odd-numbered display line and the second selection electrode to a cross point between an even-numbered display line and the first selection electrode.

2. The plasma display panel as set forth in claim 1, wherein said main electrodes include multiple parallel sustain electrodes for areal discharge as laid out at an equal interval in a horizontal direction.

3. The plasma display panel as set forth in claim 1, wherein said main electrodes are comprised of a multilayer structure of a transparent conductive film and a metallic film.

4. The plasma display panel as set forth in claim 1, wherein said main electrodes include a bus electrode of band-like shape made of a metallic film and a band-shaped transparent conductive film connected to said bus electrode and extending in parallel therewith.

5. The plasma display panel as set forth in claim 1, wherein said main electrodes include a band-shaped bus electrode made of a metallic film and a transparent conductive film coupled to said bus electrode and extending at a position of a discharge cell from said bus electrode toward a central portion of the discharge cell.

6. The plasma display panel as set forth in claim 1, wherein said selection electrodes include multiple parallel addressing electrodes as laid out at a regular interval in a vertical direction.

7. The plasma display panel as set forth in claim 1, wherein said selection electrodes are substantially two times greater in number than those discharge cells as disposed within a single display line.

8. The plasma display panel as set forth in claim 1, wherein said rib is arranged to linearly extend on or over a line connecting together said cross point between the odd-numbered display line and the second selection electrode and said cross point between the even-numbered display line and the first selection electrode.

9. A method of driving a plasma display panel as set forth in claim 1, said method comprising:

selecting, during a discharge cell selection, a discharge cell located at an odd-numbered display line and a discharge cell at an even-numbered display line; and energizing in a discharge cell turn-on event said discharge cell at the odd-numbered display line and said discharge cell at the even-numbered display line to cause them to turn on simultaneously, the cell turn-on event comprising applying a voltage to a single one of a plurality of scan electrodes.

10. The method as set forth in claim 9, wherein said method comprises letting the odd-numbered display line visually display a content corresponding to one of two fields as subdivided from a frame, said one being an odd-numbered-number field, while allowing the even-numbered display line to display a content corresponding to an even-numbered-number field of the frame.

11. The method as set forth in claim 9, wherein during discharge cell selection, even-numbered main electrodes are used as the scan electrodes for sequential application of a scan voltage.

12. The method as set forth in claim 9, wherein simultaneous selection of a discharge cell located odd-numbered display line and a discharge cell at an even-numbered display line is performed, when a certain main electrode is scanned, by simultaneous applying a select voltage to both a first selection electrode and a second selection electrode extending transverse to the main electrode thereby to cause generation of a discharge.

13. The method as set forth in claim 9, wherein simultaneous turn-on activation of a discharge cell located at an odd-numbered display line and a discharge cell at an even-numbered display line is done by causing simultaneous production of a discharge from an even-numbered main electrode toward two odd-numbered main electrodes neighboring the even-numbered main electrode and then by letting a discharge simultaneously take place in a reverse direction.

14. A method for driving a plasma display panel as set forth in claim 1, said method comprising the steps of:

dividing a frame into a plurality of subfields each consisting essentially of an address period and a turn-on retaining discharge period;

scanning alternate ones of main electrodes during the address period of each subfield thereby to cause simultaneous creation of an addressing discharge between a single main electrode as selected during scanning and two selection electrodes lying in an identical rib space intersecting said main electrode; and utilizing, in the turn-on retaining discharge period, electrical charge carriers occurred due to the addressing discharge to permit simultaneous production of a turn-on retaining discharge between one main electrode and its neighboring main electrode lying within the identical rib space.

15. A plasma display panel comprising:

a first substrate having on a surface thereof a plurality of parallel row electrodes as laid out in a stripe-like pattern;

a second substrate having a surface spatially opposed to the electrode layout surface of said first substrate and having on said opposed surface a plurality of parallel signal transmission electrodes extending in a direction transverse to said row electrodes to have a stripe-like layout pattern; and a plurality of ribs of stripe shape diagonally extending relative to said signal transmission electrodes so that intersections between display lines each formed between adjacent ones of said row electrodes and said signal transmission electrodes forms-discharge cell regions at alternate locations in a direction along said row electrodes and in a direction along said signal transmission electrodes.

16. The plasma display panel as set forth in claim 15, wherein said plurality of row electrodes include three adjacent row electrodes for constitution of two display rows with a central one of the three row electrodes constituting a scanning electrode in common to the two display rows.

17. A plasma display panel comprising:

a first substrate;

a second substrate;

a plurality of main electrodes on an inside surface of the first substrate in a substantially stripe-shaped pattern, adjacent ones of the main electrodes forming display lines therebetween;

a plurality of sets of selection electrodes on an inside surface of the second substrate in a substantially stripe-shaped pattern in a direction transverse to the main electrodes, each set of the selection electrodes including a first electrode forming a first discharge cell at a cross point with one of the display lines and a second electrode forming a second discharge cell at a cross point with the one of the display lines; and a plurality of ribs to define discharge spaces formed between the first and second substrates, each of the ribs being disposed extending from a cross point between an odd-numbered one of the display lines and the second selection electrode to a cross point between an even-numbered one of the display lines and the first selection electrode.

18. A plasma display panel comprising:

a first substrate;

a second substrate;

a plurality of main electrodes on an inside surface of the first substrate arranged at even intervals, a display line being formed between adjacent ones of the main electrodes;

a plurality of sets of selection electrodes on an inside surface of the second substrate in a substantially stripe-shaped pattern in a direction transverse to the main electrodes; and a plurality of ribs to define discharge spaces formed between the first and second substrates, the ribs extending diagonally relative to the selection electrodes.

19. The display panel as set forth in claim 18, wherein the main electrodes are arranged in a stripe-shaped pattern.

20. A plasma display panel comprising:

a first substrate;

a second substrate;

a plurality of main electrodes on an inside surface of the first substrate, adjacent ones of the main electrodes forming display lines therebetween;

a plurality of sets of selection electrodes, each set of the selection electrodes including a first electrode forming a first discharge cell at a cross point with one of the display lines and a second electrode forming a second discharge cell at a cross point with the one of the display lines; and a plurality of ribs formed between the first and second substrates, each of the-ribs extending from a cross point between an odd-numbered one of the display lines and the second selection electrode to a cross point between an even-numbered one of the display lines and the first selection electrode.

21. The plasma display panel as set forth in claim 18, wherein a discharge occurs between all of the adjacent main electrodes.

* * * * *

UNITED STATES PATENT AND TRADEMARK OFFICE

CERTIFICATE OF CORRECTION

PATENT NO. : 6,498,593 B1
DATED : December 24, 2002
INVENTOR(S) : Sunao Fujimoto et al.

It is certified that error appears in the above-identified patent and that said Letters Patent is hereby corrected as shown below:

Column 15,
Line 25, change “forms-discharge” to -- forms discharge --.

Column 16,
Line 40, change “the-ribs” to -- the ribs --.

Signed and Sealed this

Eighteenth Day of March, 2003

JAMES E. ROGAN
*Director of the United States Patent and Trademark Office*